United States Patent [19]

Decker et al.

[11] Patent Number: 4,696,426

[45] Date of Patent: Sep. 29, 1987

[54] DOCUMENT READING ENVELOPE DEPOSITORY

[75] Inventors: Dale D. Decker; Mary E. Stanhope, both of Charlotte, N.C.

[73] Assignee: IBM Corporation, Armonk, N.Y.

[21] Appl. No.: 869,169

[22] Filed: May 30, 1986

[51] Int. Cl.[4] ..... G07G 5/00

[52] U.S. Cl. ..... 232/43.1; 109/24.1; 346/22

[58] Field of Search ..... 232/43.3, 43.1, 1 D; 109/24.1, 66; 346/22

[56] References Cited

U.S. PATENT DOCUMENTS

| | | | |
|---|---|---|---|
| 2,960,377 | 11/1960 | Simjian | 109/24.1 X |
| 3,778,596 | 12/1973 | Wapner | 109/24.1 |
| 4,067,267 | 1/1978 | McLaughlin | 346/22 X |
| 4,512,263 | 4/1985 | Lanning | 109/24.1 X |
| 4,597,330 | 7/1986 | Hill et al. | 109/24.1 X |

FOREIGN PATENT DOCUMENTS

| | | | |
|---|---|---|---|
| 0045997 | 4/1977 | Japan | 109/24.1 |

*Primary Examiner*—Robert W. Gibson, Jr.
*Attorney, Agent, or Firm*—Karl O. Hesse

[57] ABSTRACT

A banking machine having a single opening for both envelope and individual check or note deposit is disclosed. The entrance to the depository has a deposit item thickness sensor just inside of the deposit gate opening which can detect the difference between a thicker envelope deposit item and a thinner single sheet of paper. A computer is responsive to signals from the thickness sensor to control a deflector which permits envelopes to pass directly through to a sequential stacking deposit bin. Alternately, the thickness sensor causes the computer to control the deflector to divert a single sheet of paper into a read leg of the bifurcated transport. After entering the read path, document alignment rolls placed at a slight angle to the direction of document travel tend to move the document toward a registration edge before the document passes the read head. After passing the read head, the document returns to the common transport at a point just past the thickness sensor and traveling in the same direction as it traveled when first inserted. This permits the document to be recirculated in the event that the document was not adequately aligned for good reading. As the document is recirculated, additional aligning is provided by the alignment rolls until the document has been moved all the way against the registration edge and proper reading can be accomplished.

11 Claims, 5 Drawing Figures

DOCUMENT READING ENVELOPE DEPOSITORY

BACKGROUND OF THE INVENTION

1. Field of the Invention

The invention relates to automatic banking machines which may be installed at locations accessible to customers for dispensing money and receiving deposits. More particularly the invention relates to machines for receiving deposits of individual checks or sheets of paper money as well as receiving deposits contained within deposit envelopes.

2. Prior Art

Banking machines with deposit mechanisms capable of receiving envelopes are well known in the prior art. Some of these prior art envelope depositories include a programmable wire matrix or ink jet printer to print sequence numbers or other information on the envelope as it is being deposited.

The IBM 4730 Personal Banking Machine has an envelope depository and in addition has a separate individual check depository. The individual check depository receives each individual check, transports the check past a magnetic ink character read head, prints audit trail information on the check and places the check into a deposit tray. Each of these separate depositories require an input gate to control articles being placed into the depository and they each require transport belts or rollers to handle the items being deposited. Each depository also requires its own programmable printer if deposited items are to be printed with audit information.

In addition the individual check reading depository must have a document aligning mechanism to ensure that the magnetic ink characters pass under the read head in adequate registration with their expected path in order to permit recognizing the characters. Because checks come in varying widths and lengths, it is not possible to control check alignment entirely by the shape of the input gate. If a narrow check being inserted and it is placed in the middle of the deposit opening, alignment rolls must be provided to move the check to one side against a registration edge so that the document magnetic rnk characters pass under the read head. It a short transport path is provided to obtain a compact depository, the transport may not be able to move the document sideways far enough to provide proper registration for reading and the document then must be returned to the user for rernsertion.

SUMMARY OF THE INVENTION

An advantageous effect of this invention is the simplification of the console of an automatic teller machine in that only one deposit opening is required. By requiring only one opening, the user can not be contused as to which deposit gate into which the deposit item should be inserted.

Further, a single deposit gate and associated actuator can serve to protect the envelope deposit mechanism and MICR reader deposit mechanism from vandalism, thereby reducing cost of the machine. A common print mechanism and control circuits can serve to print on both envelope deposits and individual document deposits, further reducing cost.

A still further advantage of the invention is that while remaining compact, it has a long read transport path. The long path allows a document being read to be moved sideways into good registration tor reading without requiring that the user reinsert the document.

These and other advantages are obtained by the instant invention which is a depository having a bifurcated transport path. The transport of documents and envelopes in the path is controlled by a computer in response to signals from a deposit item sensor. The deposit item sensor provides signals indicating whether the deposit item is a single document to be read betore deposit or an envelope to be directly passed into the print transport leg of the bifurcated transport for printing and stacking.

The computer controls a deflector to permit envelopes to pass through the common transport and directly under a programmable printer in transit to a sequential stacking deposit cartridge of the type disclosed in U.S. Pat. No. 4,512,263 of common assignee with the instant invention. In other circumstances, the computer responds to tne sensor to control tne deposit item deflector to cause a deposit item to be diverted into a read portion of the transport path when the deposit item is a thin single sheet individual check. After entering the read path, document alignment rolls placed at a slight angle to the direction of document motion tend to move the document toward a registration edge before the document passes the read head. After passing the read head, the document returns to the common transport at a point just past the sensor and traveling in the same direction as it traveled when first inserted. This permits the document to be recirculated in the event that the document was not adequately aligned for good reading. As the document is recirculated, additional aligning is provided by the alignment rolls until the document has been moved all the way against the registration edge and proper reading can be accomplished. When a proper reading is accomplished, the computer controls the deposit item deflector to pass the check into the print transport path under the programmable printer and into the deposit cartridge. In the event that proper reading cannot be accomplished in several attempts, the document is returned to the user after it has re-entered the common transport path. By reversing the common transport the document is moved backwards out through the input opening gate.

Other objects and advantages of the invention will become apparent from the following description of a preferred embodiment when read in conjunction with the drawings forming a part of this specification.

DESCRIPTION OF THE PREFERRED EMBODIMENT

Figure 1:
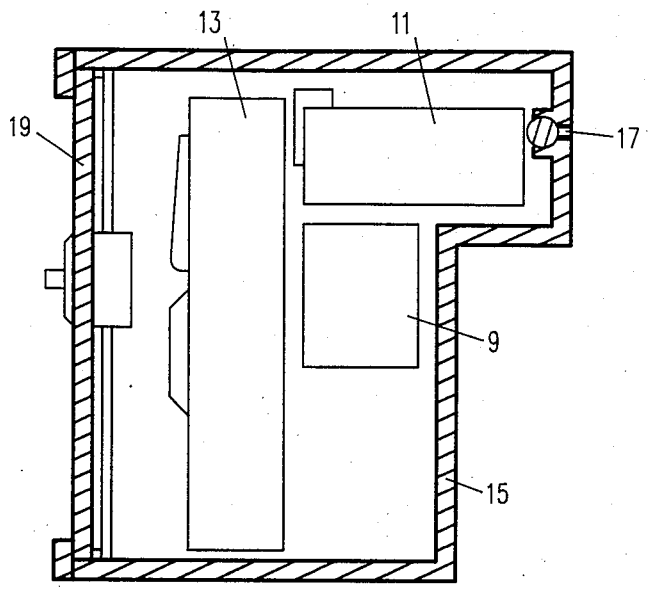
FIG. 1 shows a side view of a safe enclosure containing the depository mechanism of this invention.
Figure 3:
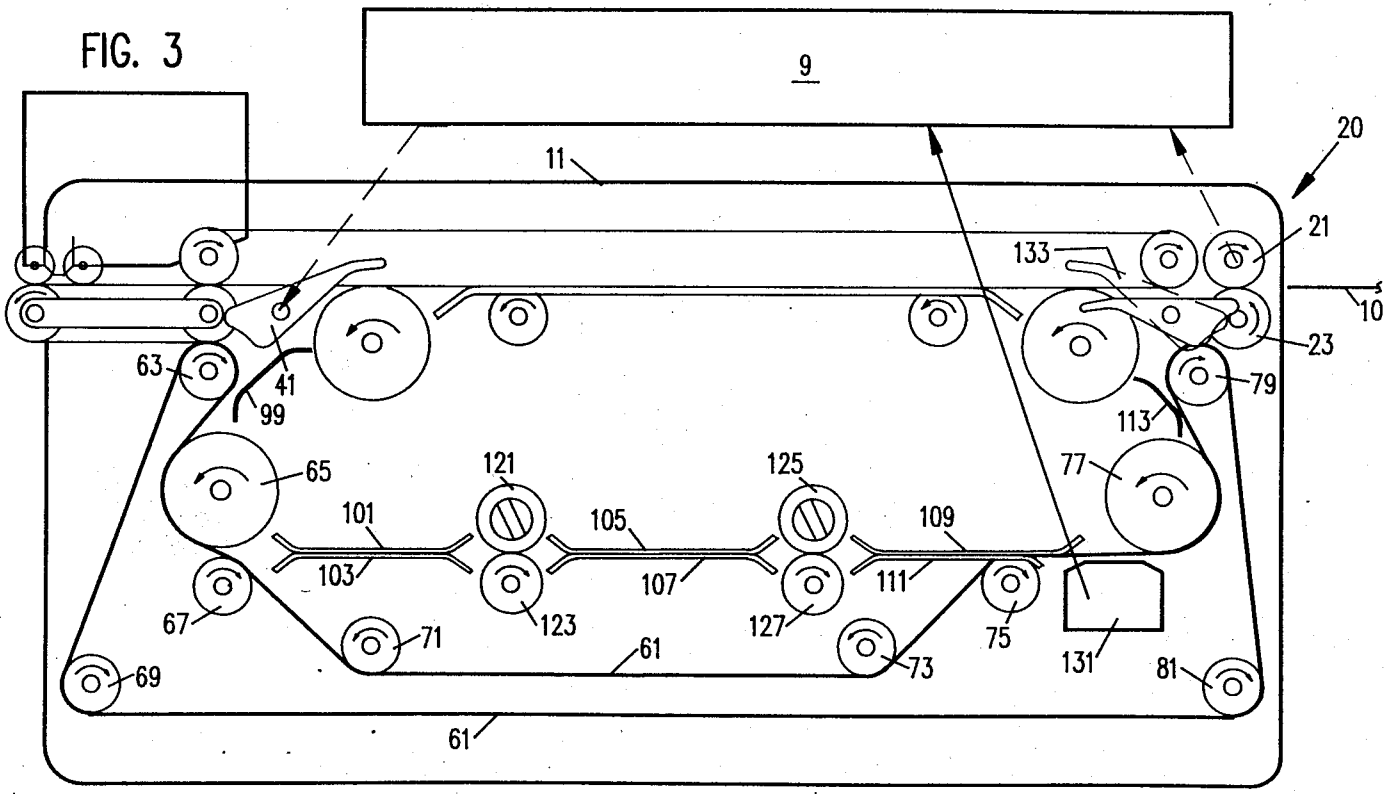
FIG. 3 shows a detailed side view of the depository mechanism in position for reading a check deposit item.

FIG. 1 shows a side view of a depository mechanism 11 constructed in accordance with the invention and mounted adjacent to a depository cartridge 13 inside of a safe enclosure 15 in order to deposit envelopes and checks therein in the sequence of their receipt. The safe 15 has a rotary gate 17 in one side which is opened or closed by an electromagnet actuator under control of computer 9 and the logic and programs of an automatic teller machine or a keyboard display, in order to control which users are granted access to use the depository. User access to rotary gate 17 is provided through front covers of an automatic teller machine or through the wall of a bank building while service access to the depository cartridge 13 is provided via safe door 19 of the normal type. In FIG. 3, computer 9 is also shown to respond to signals from sensor 20 and read head 131 to control the operation of the transport belts and rollers and to control deflector 41.

Figure 2:
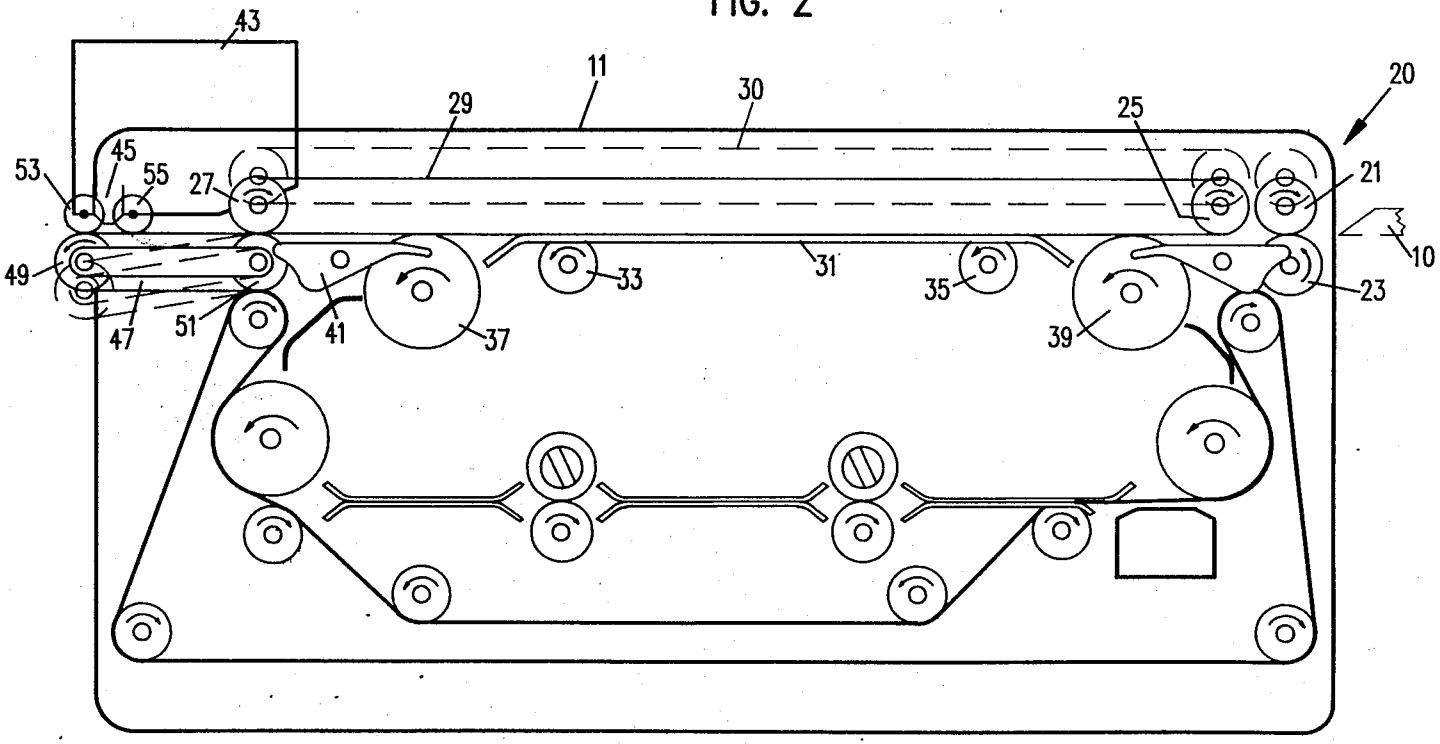
FIG. 2 shows a detailed side view of the depository mechanism in position for depositing an envelope.

Referring now to FIG. 2, a more detailed description of the depository mechanism of this invention, and particularly the common transport path while accepting a deposit, will be set forth. Immediately adjacent to rotary gate 17 is the thickness sensing rolls 21, 23 which accept deposit item 10 in the nip therebetween. Thickness sensing rolls 21, 23 are moved apart from each other by the thickness of the deposit item 10 and therefore sense the thickness of the item using well known means not described.

Adjacent and co-acting with the deposit thickness sensing rolls is the common transport path. The common transport path has rolls 25 and 27 and a belt 29 constrained to rotate thereover. Rolls 25 and 27 are mounted upon spring loaded journals so that these rolls can move away from the common transport path as thicker deposit items are inserted into the common path. Co-acting with belt 29 is transport base plate 31 and rolls 33, 35, 37, and 39 to move the deposit item through the depository mechanism to deflector 41.

Dotted lines 30 show the position of belt 29 when transporting a thick envelope deposit item.

Deflector 41 is moved into the position shown in FIG. 2 by an electromagnet actuator under control of logic and programming in a computer 9 to permit a deposit envelope to pass into the print/deposit leg of the bifurcated transport and under programmable printer 43 having a print head 45 in a position to print along the deposit item passing under the print head. Printer 43 may be, a wire dot matrix printer, an ink jet printer, or any other type of printer which is able to print upon deposit items. Programmable printer 43 may for example be configured to print upon a label which is then transported and affixed to the deposit item so as to be able to print upon a surface having constant thickness.

While passing under printer 43, the deposit item is driven by belt 47 which travels around rolls 49 and 51. Roll 49 is also mounted upon a spring loaded journal which can deflect to permit a relatively thick envelope deposit item to pass. After passing under printer 43, the deposit item is inserted onto a stack of previously deposited items by a mechanism as for example shown in U.S. Pat. No. 4,512,263. In order to assist in transporting deposit items under print head 45, rolls 53 and 55 are provided to deflect the deposit item as necessary to keep its surface at a controlled distance from print head 45 if printing is to be directly upon the document. In the situation where printing is upon a label, rolls 53 and 55 serve to affix the label to the deposit item. The rolls and belt in the immediately foregoing description comprise the print/deposit transport leg of the bifurcated transport of this invention.

The reading portions of depository mechanism 11 which function in the read leg of the bifurcated transport and in combination with the common transport path, will now be described with reference to FIG. 3. In FIG. 3, the deposit item 10 is again inserted into the nip of rolls 21, 23 which sense its thickness as the document is transported into the common path. If a thin single sheet of paper is detected, the logic and program of the controlling computer 9 operate an electromagnet actuator to move deflector 41 into the position shown in FIG. 3. Upon encountering deflector 41, the check is deflected into the read path comprising belt 61 which traverses rolls 63 through 81. Belt 61 in conjunction with rolls 63 and 79 transport the check against guide plates 99 and 113 in the read path. Rolls 65 and 67 act to divert the document away from belt 61 and between guide plates 101, 103 to guide the check into the nip between alignment roll 121 and drive roll 123. Drive roll 123 continues to carry the check between guide plates 105, 107 to alignment roll 125 and drive roll 127. Roll 127 further drives the check between guide plates 109,111 and past read head 131. Read head 131 may be a typical magnetic ink character read head or it may be an optical character read head both of which are well known in the prior art and do not constitute applicants invention. After passing read head 131, the check deposit item is carried between roll 77 and belt 61 to roll 79 and guide plate 113 where it encounters gravity operated deflector 133. Gravity operated deflector 133 is pushed by the leading edge of the check deposit item into the position shown in broken lines to permit the deposit item to re-enter the common transport path.

Operation Of The Preferred Embodiment

Figure 4:
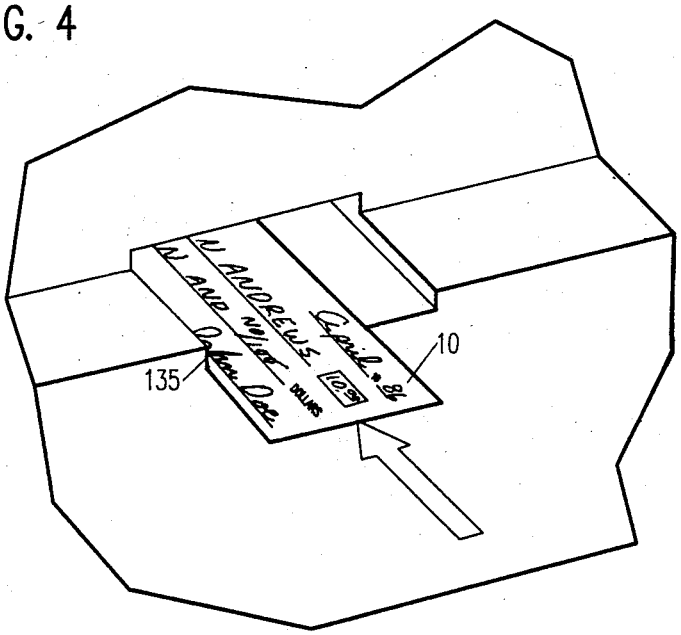
FIG. 4 shows a view of a single document being inserted into the depository of this invention.

Referring again to FIG. 1 and with reference to FIG. 4, the operation of the depository mechanism of the invention will be described. As shown in FIG. 4, a deposit item in the form of an envelope or check 10 is placed into the deposit input opening gate 17. It the deposit item is a check, it is placed, face up with the bottom edge of the document against a registration edge 135 as shown. The user is instructed to place a check deposit item in this manner by instructions displayed to the user at an associated automatic teller machine in conjunction with legends printed on the face of the depository near the depository gate. After the user has been identified to the automatic teller machine, the computer 9 causes rotary gate 17 to open permitting the check deposit item to be pushed into the nip of rolls 21, 23 shown in FIG. 3 for sensing the thickness of the deposit item as it is being transported into the common transport path.

Figure 5:
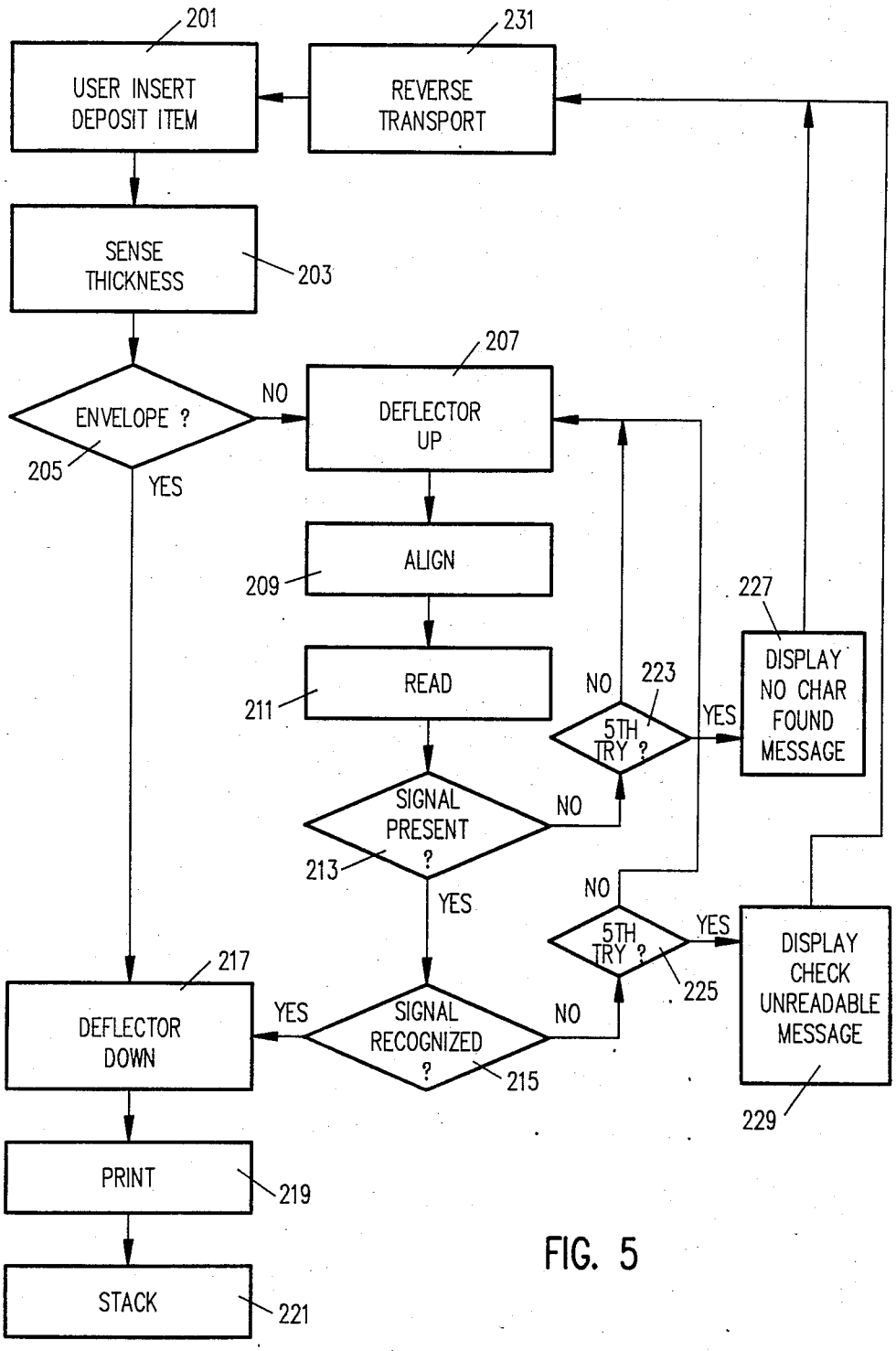
FIG. 5 shows a flow diagram of the control logic embodied in a program in the controlling computer.

Referring now to the flow chart in FIG. 5, after the user has inserted the deposit item at block 201, it is sensed for thickness at decision block 203 and computer 9 determines at block 205 if it is an envelope or a single document. In the event that the deposit item caused thickness sensing rolls 21, 23 to be separated by more than the thickness of a single sheet of paper, an envelope deposit is determined at block 205 to have been inserted and the deposit item is transported with deflector 41 in the down position shown in FIG. 2, past programmable printer 43, and into depository cartridge 13 as depicted in blocks 217, 219, and 221 respectively.

It the deposit item is a single thickness of paper, the computer 9 at block 207 will cause deflector 41 to move up to the position shown in FIG. 3 and the deposit item will be deflected into the read path comprising belt 61 and rolls 63 through 81. If when inserted, the bottom edge of the deposit item was placed far from registration edge 135, the deposit item may not have been moved up against and into alignment with the registration edge as depicted in block 209 before reaching the read head 131. In this case, the read head 131 will not be able, in block 211, to read the magnetic ink characters along the bottom edge of the check. After the deposit items passes the read head, it re-enters the common transport path through gravity operated deflector 133. Once the deposit item has re-entered the common transport path, the computer 9 can decide at block 213 whether signals were present and if they were present, it can decide at block 215, whether the signals are recognizable. If the signals are recognizable, the computer 9 at block 217 moves deflector 41 down to pass the document under printer 43 for printing at block 219 and stacking at block 221 in the cartridge 13.

If no signals were received from the read head or if they were not recognizable, the computer at blocks 223 or 225 decides whether to re-circulate the document for another attempt at reading. If, for example, less than 5 attempts at reading have been made, deflector 41 is again moved up at block 207 to the position of FIG. 3 to allow the deposit item to be re-circulated for another alignment and read attempt. If after several read attempts, no signals were received from read head 131, computer 9 will display a message at block 227 that the document may have been inserted upside down or backwards and solicit reinsertion in the correct orientation. After the deposit item clears deflector 133, deflector 133 will drop back into the position shown in FIG. 2 to permit the common transport to be operated in the reverse direction as shown at block 231 to return the deposit item to the user. The message is displayed on the display of an associated automatic teller machine advising the user that the deposit item cannot be read in the position in which it was inserted and that if it was inserted face down, it should be re-inserted face up or if the deposit item does not have magnetic ink characters, that it cannot be accepted as an individual check deposit.

On the other hand if signals were received from the read head but were not recognizable after several tries, a message is displayed by computer 9 at block 229 to the effect that the document has unreadable characters and can not be accepted as a deposit. Again the document is returned to the user at block 231 as previously described.

It can be seen from the Figures and understood from the foregoing description ot the preferred embodiment that the bifurcated transport of the invention having a common path, a print/deposit path and a read path to provide a re-circulation capability, advantageously yields a compact depository mechanism which permits functional items such as the programmable printer and rotary input gate to be utilized for the purpose of depositing both individual checks and envelopes. In addition, it can be seen that by means of the re-circulation path utilizing the common path and the read path, a deposit item can be re-circulated past alignment rolls a number of times, each pass moving the deposit item into better registration and alignment for reading without the need for returning the deposit item to the user unless the deposit item has been inserted upside down or backwards.

While the invention has been shown and described with respect to an envelope depository in combination with a check reader, it will be appreciated by those skilled in the art that read head 131 could be of the type to read and recognize paper currency or magnetic stripe documents which then are handled in much the same way as described for a check. It will be further appreciated that without departing from the spirit and scope of the invention, through the use of another deflector similar to deflector 41 following rolls 49, 53, documents may be separately stacked into different cartridges as is known in the art and exemplified by U.S. Pat No. 4,552,351 of common assignee with the instant invention. Likewise the addition or removal of printing or other functional units is contemplated by the inventors as being within the scope of their invention which is measured by the following claims.

Having described our invention, what we claim is:

1. A depository comprising:

a single opening for receiving both envelopes and single document deposit items;

a common transport for receiving said deposit items from said opening;

a thickness detector mounted between said opening and an input end of said common transport for detecting whether a deposit item is a single document;

a diverter mounted at an output end of said common transport for diverting single documents from said common transport to an input end of a read transport;

said diverter passing deposit items which are envelopes to a deposit receiving means.

2. The depository of claim 1 further comprising means mounted at an output end of said read transport for re-entering single documents into said common transport.

3. The depository of claim 2 having an aligner mounted adjacent said read transport for moving each single document toward a registration edge as each single document is transported.

4. The depository of claim 3 having a read head mounted between said aligner and said output end of said read transport for reading said single documents.

5. The depository of claim 4 having control means connected to said diverter for controlling said diverter to pass said single documents which have been correctly read to said deposit receiving means, said control means controlling said diverter to again divert said single documents which were not correctly read, to said read transport for further aligning and reading.

6. Tne depository of claim 5 turther comprising a printer mounted between said diverter and said depository receiving means for printing on deposit items as they are being placed in said deposit receiving means.

7. The depository of claim 6 wherein said deposit receiving means comprises a receptacle for stacking botn envelopes and single documents in the sequence of their receipt.

8. A depository capable of accepting both envelope deposit items and single document deposit items comprising: a single deposit receiving means adjacent to a bifurcated transport for carrying envelopes directly to a deposit receptacle and alternately for carrying single documents past a document reader;

detector means for differentiating between envelope deposit items and sirngle document deposit items;

control means responsive to said detector means for controlling said bifurcated transport to carry an envelope directly to a deposit receptacle, and alternately for controlling said bifurcated transport to carry a single document past a reading means for reading information from said single document prior to carrying said single document to said document receptacle.

9. The depository of claim 8 wherein one leg of said bifurcated transport carries deposit items directly to said deposit receptacle and wherein another leg of said bifurcated transport carries single document deposit items past a read means and thereafter to said first leg for carriage to said deposit receptacle.

10. The depository of claim 9 wherein said first leg carries deposit items past a printing means for printing on said deposit items as they are being carried.

11. The depository of claim 8 wherein said detector means is a thickness sensor.

* * * * *